US005633779A

United States Patent [19]

Knoble et al.

[11] Patent Number: 5,633,779

[45] Date of Patent: May 27, 1997

[54] RELAY CONTROL CIRCUIT AND METHOD FOR CONTROLLING A RELAY

[75] Inventors: David W. Knoble, Tupelo; Khosrow Jamasbi, Belden, both of Miss.; James V. Olson, Indianapolis, Ind.

[73] Assignee: Thomas Lighting, Tupelo, Miss.

[21] Appl. No.: 432,266

[22] Filed: May 1, 1995

[51] Int. Cl.[6] ..... H01H 47/32

[52] U.S. Cl. ..... 361/187; 361/155; 307/130

[58] Field of Search ..... 361/187, 155, 361/189, 190, 205, 156, 195–198, 159; 307/130; 327/459, 469, 475, 476; 315/307

[56] References Cited

U.S. PATENT DOCUMENTS 3,519,893 7/1970 Schwartz ..... 361/153

3,581,117 5/1971 Dixon ..... 327/379

*Primary Examiner*—Fritz Fleming

*Attorney, Agent, or Firm*—Hill, Steadman & Simpson

[57] ABSTRACT

A control relay circuit and method for controlling a relay having a coil, for use, in particular, in operation of a light fixture circuit having an HID lamp. The relay control circuit has an input for receiving a control voltage signal and a voltage storage element connected across the input. The voltage storage element develops a voltage level as a function of time in response to the control voltage signal. A thyristor circuit, a switching element and the coil of the relay form a series circuit that is connected in parallel to voltage storage element A switch controller is connected in parallel to the voltage storage element and is also connected to the switching element. In response to the control voltage being received at said input, the switch controller activates the switching element to a conductive state at a first voltage level across the voltage storage element and the thyristor changes from a non-conductive state to a conductive state at a second voltage level across the voltage storage element, the first voltage level being less than the second voltage level. In response to the control voltage being removed from the input, the switch controller activates the switching element to a non-conductive state at a third voltage level across the voltage storage element thereby changing the thyristor from the conductive state to the non-conductive state thereof, the third voltage level being less than the second voltage level. The relay is energized at the second voltage level and is deenergized at the third voltage level.

15 Claims, 2 Drawing Sheets

RELAY CONTROL CIRCUIT AND METHOD FOR CONTROLLING A RELAY

BACKGROUND OF THE INVENTION

The present invention relates in general to a relay control circuit for controlling a relay and, in particular, a relay control circuit for controlling a light fixture circuit.

In the prior art, HID lamps are operated between a high or full intensity light level and a dim or reduced light intensity level in response to a control signal. The change of intensity level of the light output of the HID lamp is effected by changing a capacitance value in the light fixture circuit. This is accomplished by connecting and disconnecting a first capacitor across a second capacitor by means of relay contacts. Although the prior art systems provided good operation for switching the HID lamp between high and low light output settings, it has been found that when the relay has normally-closed contacts, the useful life of the relay is limited. The drawback of such a controller circuit is in the deactivation of the relay. The prior art controller circuit that controls operation of the relay produces a gradually decreasing current flow through the coil of the relay. As a result, the speed with which the rocker of the relay opens is slower than if the current were suddenly switched to zero through the coil. This places less force on closing the normally-closed contacts than is desirable. This lower contact force causes the contacts to degrade more rapidly, eventually failing by welding together.

The present invention overcomes these drawbacks in the prior art controller.

SUMMARY OF THE INVENTION

It is an object of the present invention to provide an improved relay control circuit for controlling a relay, in particular, a relay used to operate an HID lamp.

In general terms, the present invention is a relay control circuit and method for controlling the relay, the relay having a coil and at least one set of normally closed contacts. The relay control circuit has an input for receiving a control voltage signal and a voltage storage element connected across the input. The voltage storage element develops a voltage level as a function of time in response to the control voltage signal. A thyristor circuit, a switching element and the coil of the relay form a series circuit that is connected in parallel to voltage storage element. A switch controller is connected in parallel to the voltage storage element and is also connected to the switching element. In response to the control voltage being received at said input, the switch controller activates the switching element to a conductive state at a first voltage level across the voltage storage element and the thyristor changes from a non-conductive state to a conductive state at a second voltage level across the voltage storage element, the first voltage level being less than the second voltage level. In response to the control voltage being removed from the input, the switch controller activates the switching element to a non-conductive state at a third voltage level across the voltage storage element thereby changing the thyristor from the conductive state to the non-conductive state thereof, the third voltage level being less than the second voltage level. The relay is energized at the second voltage level and is deenergized at the third voltage level.

BRIEF DESCRIPTION OF THE DRAWINGS

Features of the present invention which are believed to be novel are set forth with particularity in the appended claims.

The invention together with further objects and advantages may best be understood by reference to the following description, taken in conjunction with the accompanying drawings, in the several figures of which like reference numerals identify like elements, and in which.

DESCRIPTION OF THE PREFERRED EMBODIMENTS

Figure 4:
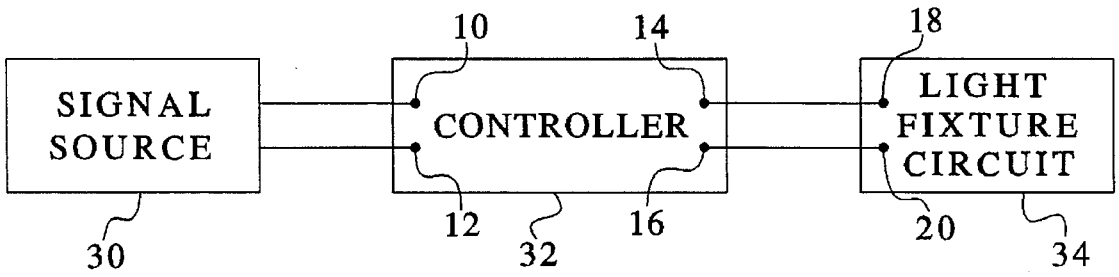
FIG. 4 is a general block diagram depicting one embodiment of the present invention.

The present invention has general applicability, but is most advantageously utilized in a system as depicted in FIG. 4. As depicted in FIG. 4, a signal source 30 is connected to a controller 32 which receives a control voltage signal on terminals 10 and 12 thereof. The controller 32 is connected to a light fixture circuit 34 that contains, for example, an HID lamp. The controller 32 has output terminals 14 and 16 connected to input terminals 18 and 20, respectively, of the light fixture circuit 34.

Figure 1:
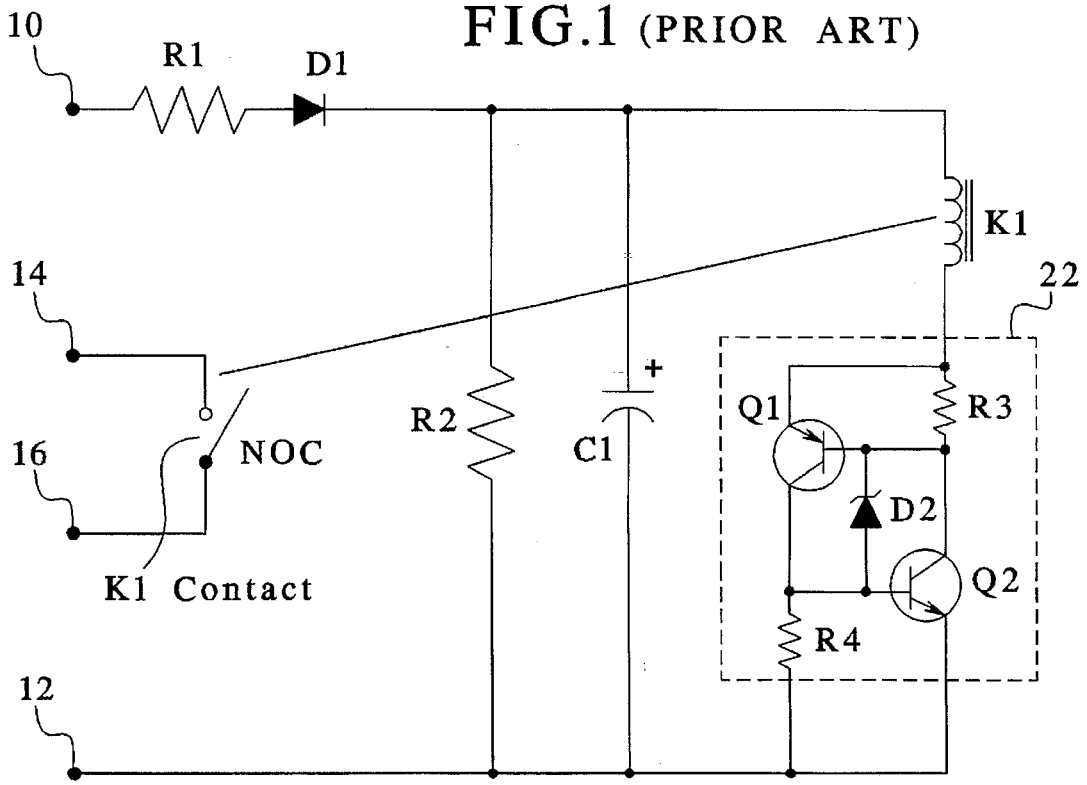
FIG.1 (PRIOR ART)
FIG. 1 is a circuit diagram of a prior art controller for controlling a light fixture circuit.

FIG. 1 depicts a prior art controller in which input terminal 10 is connected to input terminal 12 via the series circuit of resistor R1, diode D1 and resistor R2. A storage capacitor C1 is connected across resistor R2. Also, connected across resistor R2 is a series circuit composed of the coil of relay K1, and a thyristor circuit 22. The thyristor circuit 22 is formed by transistors Q1 and Q2 with resistors R3 and R4 and diode D2 as depicted in FIG. 1. Normally-opened contacts NOC of the relay K1 are connected across output terminals 14 an 16 of the controller.

Operation of this prior art controller depicted in FIG. 1 is as follows. When approximately 120 volts AC is applied between terminals 10 and 12, the capacitor C1 charges. Transistors Q1 and Q2, and the supporting circuitry of resistors R3 and R4 and diode D2 form the effective thyristor circuit 22. When a voltage is placed across this thyristor circuit 22, the transistors Q1 and Q2 will remain in the off-state until the voltage exceeds a threshold determined by diode D2. When this threshold is exceeded, current flows through the circuit with transistors Q1 and Q2 now in a conductive state, until the voltage across the circuit is reduced to zero volts. Therefore, when capacitor C1 charges up to an appropriate voltage (about 50 volts), transistors Q1 and Q2 turn-on, permitting current to flow through the relay coil of relay K1. It is a property of relays that they need a higher voltage to activate then to maintain. That is, it takes a higher voltage to close the rocker of the relay magnetically, than to keep the rocker closed. Furthermore, the use of the circuit permits lower current to be used, lessening power consumption, resistor temperatures, etc.

The drawback of this prior art circuit depicted in FIG. 1 is in the deactivation of the relay. This drawback was identified during light tests, in which the contacts of the relay did not exhibit sufficiently long life. When the control voltage is removed from terminals 10 and 12, the capacitor C1 gradually discharges through the coil of relay K1. At some point in time, the current is sufficiently low in that the rocker of relay K1 opens. However, due to the current still flowing through the coil of relay K1, the speed with which the rocker opens is less than desired. As previously mentioned this places less force in closing the contacts of the relay K1 than is desirable. This lower contact force will eventually destroy the contacts of the relay K1.

Figure 2:
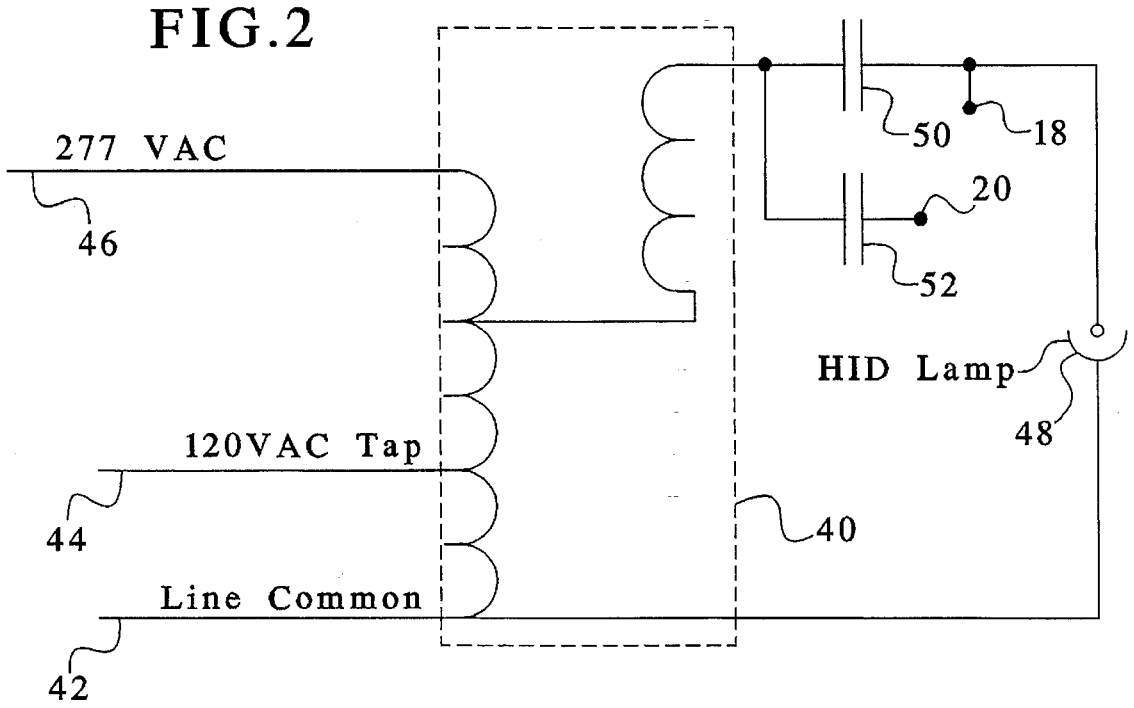
FIG. 2 is a circuit diagram of a light fixture circuit for use in the present invention.

FIG. 2 depicts a typical light fixture circuit for an HID lamp in which a transformer 40 is connected on one side to an AC line having a line common 42, 120 volt AC tap 44, and a 277 volt AC line 46. The other side of the transformer 40 is connected to the HID lamp 48 via a first capacitor 50. A second capacitor 52 is connectable across the first capacitor 50 by means of the relay contacts of the relay K1 in the controller 32. The change in capacitance effected by the connection and disconnection of the second capacitor 52 across the first capacitor 50, produces the change in light intensity level of the HID lamp 48.

Figure 3:
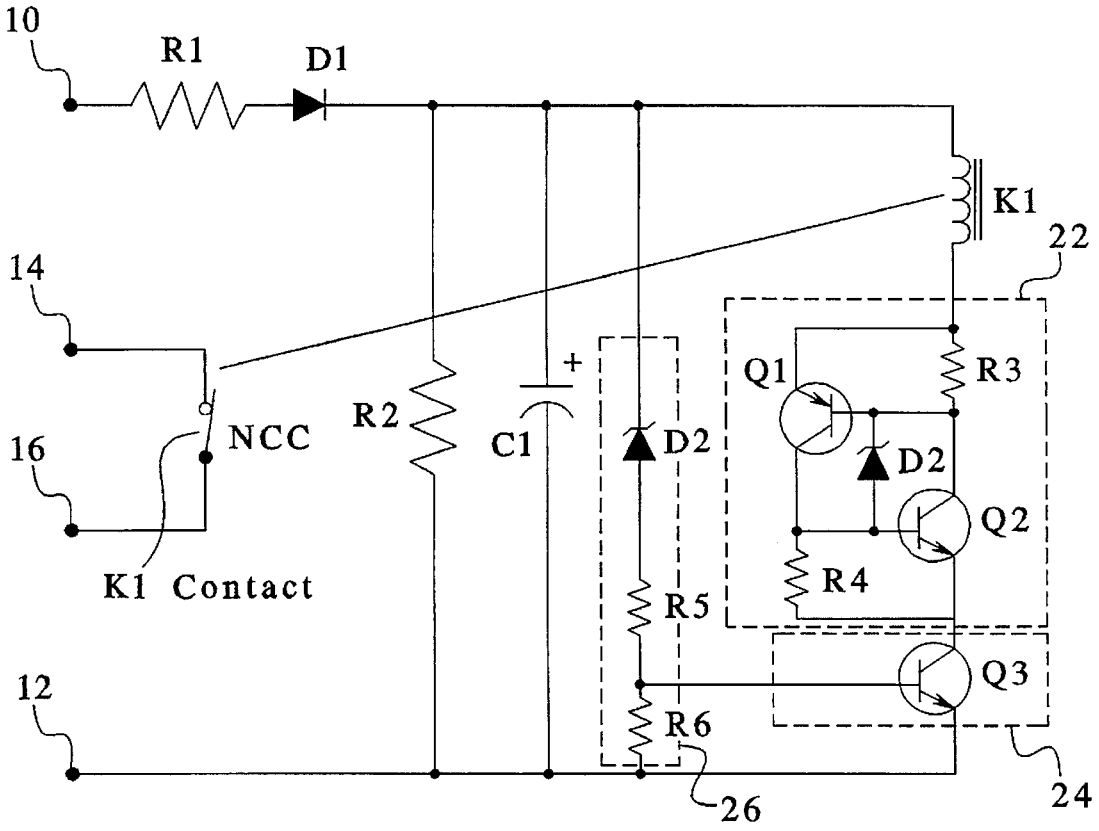
FIG. 3 is a circuit diagram of a relay control circuit of the present invention for controlling the light fixture circuit of FIG. 2.

The present invention, which overcomes the drawbacks of the FIG. 1 prior art controller, is depicted in FIG. 3. The controller of the present invention has a switch element 24 which is connected in series with the coil of the relay K1 and the thyristor circuit 22. In particular, the switch element 24 has a transistor Q3 with its collector-emitter path connected between input terminal 12 and the transistor Q2 of the thyristor circuit 22. A switch controller 26 has a zener diode D3 in series with resistors R5 and R6. The switch controller 26 is connected across capacitor C1. The juncture of resistors R5 and R6 is connected to the base of transistor Q3 for turning Q3 on and off. The transistor Q3 is on, or in a conductive state, anytime that the voltage on capacitor C1 is higher than the characteristic voltage zener diode D3. When a control voltage is applied to input terminals 10 and 12, the voltage on capacitor C1 increases until zener diode D3 conducts. At this point in time, current flows through resistors R5 and R6 thereby turning on a transistor Q3. The voltage on capacitor Cl then continues to increase until transistors Q1 and Q2 turn on, activating the relay K1 as described above. Thus, activation of the relay is essentially unchanged, since transistor Q3 is always in a conductive state before transistors Q1 and Q2 turn on. The relay K1 can have a plurality of contacts, such as XCC and NCC.

When the control voltage is removed from input terminals 10 and 12, the following occurs. The voltage on capacitor C1 decreases as its stored energy is drained by the coil of relay K1. Each of transistors Q1, Q2 and Q3 are still in a conductive state. However, when the voltage on capacitor C1 decreased to a low enough level, zener diode D3 ceases to conduct, and transistor Q3 turns off. When transistor Q3 turns off and becomes non-conductive, current through the coil of relay K1 ceases to flow, and transistors Q1 and Q2 then also turn off. Thus, the relay rocker releases with no current flowing through the coil of relay K1, and the proper closure forces are applied to the normally-closed contacts. Whereas in the prior art controller circuit depicted in FIG. 1 the rocker of the relay K1 closed slowly due to the gradually decreasing current flow through the coil of the relay K1, in the present invention depicted in FIG. 3 the current flow through the coil of K1 is suddenly cut-off, that is dropped to zero, and the rocker of the relay K1 closes rapidly and prevents damage to the normally-closed contacts of the relay K1. The following is a further description of the light control system of the present invention for changing light intensity levels of a lamp, such as lamp 48 in FIG. 2. The light fixture circuit 34 (see FIG. 4) is connected to the lamp 48. The light fixture circuit 34 operates the lamp 48 at a first intensity level at a first circuit setting and at a second intensity level at second circuit setting. The light fixture circuit 34 has first and second input terminals 18, 20 connected to setting circuitry for forming the first and second circuit settings.

A relay control circuit (controller 32 in FIG. 4) has a relay having a coil K1 and at least one set of normally-closed contacts XCC, NCC (see FIG. 3). The normally-closed contacts (NCC for example in FIG. 3) are connected to first and second output terminals 14, 16 of the relay control circuit 32. The first and second output terminals 14, 16 of the relay control circuit 32 are operatively connected to the first and second input terminals 18, 20 of said light fixture circuit 34, respectively.

The relay control circuit 32 has first and second input terminals 10, 12 for receiving a control voltage signal from signal source 30 (see FIG. 4).

The relay control circuit 32 has a voltage storage element C1 connected across the first and second input terminals 10, 12 of the relay control circuit 32. The voltage storage element C1 develops a voltage level as a function of time in response to the control voltage signal. The relay control circuit 32 also has a thyristor circuit 22, a switching element 24 and the coil K1 of the relay that form a series circuit that is connected in parallel to the voltage storage element C1. The relay control circuit 32 further has a switch controller 26 connected in parallel to the voltage storage element C1 and also connected to the switching element 24.

Responsive to the control voltage being received at the first and second input terminals 10, 12 of the relay control circuit 32, the switch controller 26 activates the switching element 24 to a conductive state at a first voltage level across the voltage storage element C1 and the thyristor circuit 22 changes from a non-conductive state to a conductive state at a second voltage level across the voltage storage element. The first voltage level is less than said second voltage level.

Responsive to the control voltage being removed from the first and second input terminals 10, 12 of the relay control circuit 32, the switch controller 26 activates the switching element 24 to a non-conductive state at a third voltage level across the voltage storage element C1 thereby changing the thyristor circuit 22 from the conductive state to the non-conductive state thereof. The third voltage level is less than the second voltage level. The relay is energized at the second voltage level whereby the light fixture circuit 34 forms the first setting and the lamp 48 is operated at the first intensity level. The relay is deenergized at the third voltage level whereby the light fixture circuit 34 forms the second setting and the lamp 48 is operated at the second intensity level.

The invention is not limited to the particular details of the method and apparatus depicted and other modifications and applications are contemplated. Certain other changes may be made in the above-described apparatus and method without the parting from the true spirit and scope of the invention herein involved. It is intended, therefore, that the subject matter in the above-depiction shall be interpreted as illustrative and not in a limiting sense.

What is claimed is:

1. A relay control circuit for controlling a relay having a coil, comprising:

an input for receiving a control voltage signal;

a voltage storage element connected across said input, said voltage storage element developing a voltage level as a function of time in response to said control voltage signal;

a thyristor circuit, a switching element and the coil of the relay forming a series circuit that is connected in parallel to said voltage storage element;

a switch controller connected in parallel to said voltage storage element and also connected to said switching element;

responsive to said control voltage being received at said input, said switch controller activating said switching element to a conductive state at a first voltage level across said voltage storage element and said thyristor changing from a non-conductive state to a conductive state at a second voltage level across said voltage storage element, said first voltage level being less than said second voltage level;

responsive to said control voltage being removed from said input, said switch controller activating said switching element to a non-conductive state at a third voltage level across said voltage storage element thereby changing said thyristor from the conductive state to the non-conductive state thereof, said third voltage level being less than said second voltage level; and wherein said relay is energized at said second voltage level and is deenergized at said third voltage level.

2. The relay control circuit according to claim 1, wherein said relay has at least one set of normally-closed contacts, and wherein when said control voltage signal is removed from said input and when the voltage level across the voltage storage element reduces to said third voltage level, said switching element causes said relay to release with substantially zero current through said coil resulting in a predetermined closure force of said normally-closed contacts.

3. The relay control circuit according to claim 1, wherein said voltage storage element is a capacitor.

4. The relay control circuit according to claim 1, wherein said thyristor circuit has; a first transistor with an emitter-collector path connected between the coil and an input terminal of the input, a second transistor with a collector-emitter path connected between the coil and the input terminal, a base of the first transistor connected to the collector of the second transistor and a base of the second transistor connected to the collector of the first transistor, and a zener diode connected from the base of the second transistor to the base of the first transistor.

5. The relay control circuit according to claim 1, wherein said switch controller has; a series circuit having first and second resistors and a zener diode, said series circuit connected in parallel to said voltage storage element, and wherein said switching element is a switching transistor having a collector-emitter path connected between the thyristor circuit and an input terminal of the input and a base connected to a juncture of said first and second resistors.

6. A method for controlling a relay having a coil, comprising:

providing a control voltage signal to an input;

providing a voltage storage element connected across said input, said voltage storage element developing a voltage level as a function of time in response to said control voltage signal;

providing a series circuit having a thyristor circuit, a switching element and the coil of the relay, the series circuit being connected in parallel to said voltage storage element;

providing a switch controller connected in parallel to said voltage storage element and also connected to said switching element;

activating via said switch controller, in response to said control voltage being received at said input, said switching element to a conductive state at a first voltage level across said voltage storage element and said thyristor changing from a non-conductive state to a conductive state at a second voltage level across said voltage storage element, said first voltage level being less than said second voltage level;

activating via said switch controller, in response to said control voltage being removed from said input, said switching element to a non-conductive state at a third voltage level across said voltage storage element thereby changing said thyristor from the conductive state to the non-conductive state thereof, said third voltage level being less than said second voltage level; and wherein said relay is energized at said second voltage level and is deenergized at said third voltage level.

7. The method according to claim 6, wherein said relay has at least one set of normally-closed contacts, and wherein when said control voltage signal is removed from said input and when the voltage level across the voltage storage element reduces to said third voltage level, said switching element causes said relay to release with substantially zero current through said coil resulting in a predetermined closure force of said normally-closed contacts.

8. The method according to claim 6, wherein said voltage storage element is a capacitor.

9. The method according to claim 6, wherein said thyristor circuit has; a first transistor with an emitter-collector path connected between the coil and an input terminal of the input, a second transistor with a collector-emitter path connected between the coil and the input terminal, a base of the first transistor connected to the collector of the second transistor and a base of the second transistor connected to the collector of the first transistor, and a zener diode connected from the base of the second transistor to the base of the first transistor.

10. The method according to claim 6, wherein said switch controller has a series circuit having first and second resistors and a zener diode, said series circuit connected in parallel to said voltage storage element, and wherein said switching element is a switching transistor having a collector-emitter path connected between the thyristor circuit and an input terminal of the input and a base connected to a juncture of said first and second resistors.

11. A light control system for changing light intensity levels of a lamp, comprising:

a light fixture circuit connected to said lamp, said light fixture circuit operating said lamp at a first intensity level at a first circuit setting and at a second intensity level at second circuit setting, said light fixture circuit having first and second input terminals connected to setting circuitry for forming said first and second circuit settings;

a relay control circuit having a relay, said relay having a coil and at least one set of normally-closed contacts, said normally-closed contacts connected to first and second output terminals of said relay control circuit, said first and second output terminals of said relay control circuit operatively connected to said first and second input terminals of said light fixture circuit, respectively;

said relay control circuit having first and second input terminals for receiving a control voltage signal;

said relay control circuit having a voltage storage element connected across said first and second input terminals of said relay control circuit, said voltage storage element developing a voltage level as a function of time in response to said control voltage signal;

said relay control circuit having a thyristor circuit, a switching element and the coil of the relay forming a series circuit that is connected in parallel to said voltage storage element;

said relay control circuit having a switch controller connected in parallel to said voltage storage element and also connected to said switching element;

responsive to said control voltage being received at said first and second input terminals of said relay control circuit, said switch controller activating said switching element to a conductive state at a first voltage level across said voltage storage element and said thyristor changing from a non-conductive state to a conductive state at a second voltage level across said voltage storage element, said first voltage level being less than said second voltage level;

responsive to said control voltage being removed from said first and second input terminals of said relay control circuit, said switch controller activating said switching element to a non-conductive state at a third voltage level across said voltage storage element thereby changing said thyristor from the conductive state to the non-conductive state thereof, said third voltage level being less than said second voltage level; and wherein said relay is energized at said second voltage level whereby said light fixture circuit forms said first setting and said lamp is operated at said first intensity level, and wherein said relay is deenergized at said third voltage level whereby said light fixture circuit forms said second setting and said lamp is operated at said second intensity level.

12. The light control system according to claim 11, wherein when said control voltage signal is removed from said first and second input terminals of said relay control circuit and when the voltage level across the voltage storage element reduces to said third voltage level, said switching element causes said relay to release with substantially zero current through said coil resulting in a predetermined closure force of said normally-closed contacts.

13. The light control system according to claim 11, wherein said voltage storage element is a capacitor.

14. The light control system according to claim 11, wherein said thyristor circuit has; a first transistor with an emitter-collector path connected between the coil and the second input terminal, a second transistor with a collector-emitter path connected between the coil and the second input terminal of the relay control circuit, a base of the first transistor connected to the collector of the second transistor and a base of the second transistor connected to the collector of the first transistor, and a zener diode connected from the base of the second transistor to the base of the first transistor.

15. The light control system according to claim 11, wherein said switch controller has a series circuit having first and second resistors and a zener diode said series circuit connected in parallel to said voltage storage element, and wherein said switching element is a switching transistor having a collector-emitter path connected between the thyristor circuit and the second input terminal of the relay control circuit and a base connected to a juncture of said first and second resistors.

* * * * *